United States Patent [19]

Ferrar et al.

[11] Patent Number: 4,769,262

[45] Date of Patent: Sep. 6, 1988

[54] PACKAGING OF FRESH FRUIT AND VEGETABLES

[75] Inventors: Andrew N. Ferrar, Bolton; Arthur N. Jones, Beaconsfield; Albert P. Taylor, Bury, all of England

[73] Assignee: Bunzl Flexpack Limited, United Kingdom

[21] Appl. No.: 932,314

[22] Filed: Nov. 19, 1986

[30] Foreign Application Priority Data

Nov. 19, 1985 [GB] United Kingdom ..... 8528428

[51] Int. Cl.[4] ..... B65D 81/18; B65B 51/10

[52] U.S. Cl. ..... 428/35; 53/477; 206/484.1; 426/106; 426/396; 426/415; 426/419

[58] Field of Search ..... 426/106, 396, 415, 419; 428/35; 53/477; 206/484.1

[56] References Cited

U.S. PATENT DOCUMENTS

| | | | |
|---|---|---|---|
| 3,027,997 | 4/1962 | Reifers | 426/415 |
| 3,397,068 | 8/1968 | Schaefer et al. | 426/396 |
| 3,663,240 | 5/1972 | Seiferth et al. | 426/415 |
| 4,061,443 | 1/1977 | Dave | 426/415 |
| 4,061,785 | 12/1977 | Nishino et al. | 426/396 |
| 4,224,347 | 9/1980 | Woodruff | 426/415 |
| 4,423,080 | 12/1983 | Bedrosian et al. | 426/415 |
| 4,642,239 | 2/1987 | Ferrar et al. | 426/415 |

OTHER PUBLICATIONS

Stahl et al., Pliofilm in the preservation of fruits and vegetables.

*Primary Examiner*—John E. Kittle
*Assistant Examiner*—James J. Seidleck
*Attorney, Agent, or Firm*—Reese Taylor

[57] ABSTRACT

The packaging of fresh fruit and vegetables is effected in a package at least part of which is made of a transparent film of a polymeric material. The film has a high rate of gas permeability and is impervious to the ingress of bacteria. As the fruit and vegetables continue to respire in the package an atmosphere is set up inside the package which serves to retard spoilage, mould growth and flavor deterioration, thereby providing the package with a longer shelf life than an open receptacle. The film is preferably polymethyl pentene and may form all the container or a lid to a rigid receptacle.

15 Claims, 1 Drawing Sheet

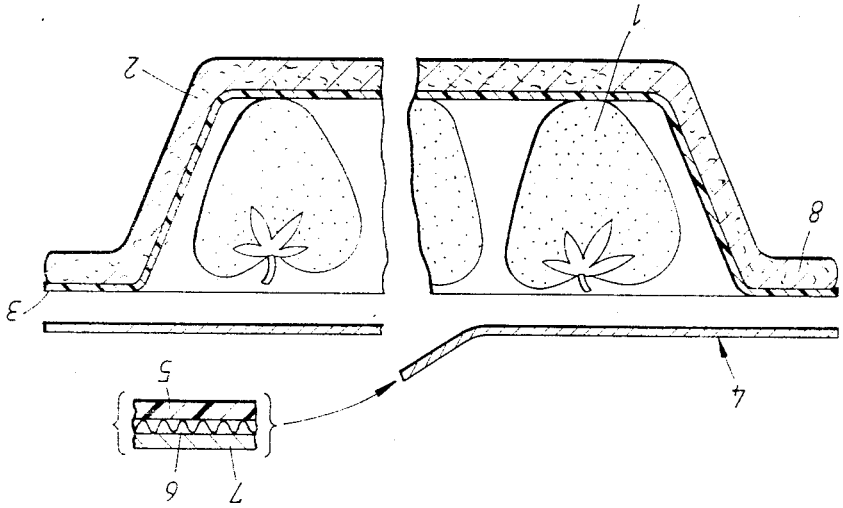
7
6
5
4
3
2
1
8

PACKAGING OF FRESH FRUIT AND VEGETABLES

FIELD OF THE INVENTION

This invention relates to packages and to the packaging of fresh fruit and vegetables.

BACKGROUND TO THE INVENTION

Some fresh fruit and vegetables, particularly soft fruits, such as strawberries, have a very short shelf-life, particularly in supermarkets and the like, and it is known that open punnets of strawberries undergo considerable deterioration and spoilage even after one day so that, in general, it is not economic for supermarkets to sell strawberries.

We have now discovered that by packaging fresh fruit and vegetables in certain materials it is possible to increase their shelf-life quite considerably.

SUMMARY OF THE INVENTION

According to one aspect, the present invention provides a package of fresh fruit or vegetables, wherein the fruit or vegetables are packaged in a container, characterised in that at least a part of the wall of the container is made of a transparent film of a polymeric material, which film has a high rate of gas transmission and which film is impervious to the ingress of bacteria to the interior of the package. The polymeric material is preferably polymethyl pentene or a copolymer comprising methyl pentene.

According to another aspect of the present invention there is provided a method of packaging fresh fruit or vegetables, comprising the steps of placing the fruit or vegetables into a container, characterised in that at least a part of the wall of the container is made of a transparent film of a polymeric material which film has a high rate of gas transmission and which film is impervious to the ingress of bacteria into the interior of the package, and in that the package is closed by a heat-sealing operation.

Generally speaking the package will be in the form of a rigid punnet, tray or like receptacle which holds the fresh fruit or vegetables and which provides the fruit or vegetables with physical protection from damage during transport and distribution. The receptacle may be a rigid receptacle preformed from a thermoplastic material such as from sheet polyvinylchloride (PVC) or may be made from a non-thermoplastic material lined with a thermoplastic material. A preferred lining material is a PVC/ionomer laminate of which the ionomer layer bonds well to the receptacle and the PVC layer provides a thermoplastic layer for fusing to the lid, the laminate having a thickness of 40 to 100 microns.

The rigid receptacle in which the fruit or vegetables are packed has a lid made of a transparent flexible film which allows a very high rate of gas transmission but which at the same time acts as a barrier to the passage of bacteria. As indicated, the film is advantageously polymethyl pentene or a copolymer of polymethyl pentene but, in order to permit the film to be heat-sealed to the rigid receptacle, the film is coated with a polymer of a much lower softening point than that of polymethyl pentene. This coating can cover the entire surface of the film or can be restricted to only those areas where heat-sealing is to take place. Acrylic polymers are suitable coating polymers as they possess the required properties of good clarity, high gas transmission rates and good heat-seal bond strength to the rigid receptacle which, as indicated, is either made of thermoplastic material or has a lining of thermoplastic material on a non-thermoplastic base. Vinyl or polyester polymers can also be used to coat the lidding film. State of the art surfactants can be incorporated in these coatings to improve wetting and thereby improving the antifog property.

It has been found that the present packages provide fresh fruit and vegetables with physical protection whilst allowing natural respiration to continue through the gas-pervious film of transparent polymer It has surprisingly been found that fresh fruit and vegetables, particularly soft fruit, such as strawberries, have an extended shelf-life which may be up to four times as long as when the fruit and vegetables are presented in open containers. It is believed that this is due to the fact that an optimum equilibrium atmosphere is set up within the package to retard spoilage, mould growth and deterioration in flavour and/or texture. In this connection, it is to be appreciated that, even when packaged, fruit and vegetables remain living organisms which continue to breathe, absorbing significant amounts of oxygen from the atmosphere and giving off carbon dioxide. The atmosphere in the package is therefore constantly changing when the package is first formed, but it gradually approaches an equilibrium depending on the permeability properties of the film.

To this end the gas-permeability of the transparent film is chosen to allow the optimum atmosphere to be set up within the package. The film is permeable to oxygen and to carbon dioxide as well as to nitrogen and water vapour. In general the permeability to oxygen is in the range of from 20,000 to 80,000 cc/m$^2$/d/atm at 25° C., while the permeability to carbon dioxide is higher, being generally in excess of 100,000 cc/m$^2$/d/atm at 25° C. The permeability of the film to nitrogen may be greater than 5000 cc/m$^2$/d/atm at 25° C., while its permeability to water vapour may be 50 to 120 g/m$^2$/d when tested under tropical conditions of 380° C., and 90% relative humidity. The actual permeability of the film will of course be chosen in accordance with the requirements of the fresh fruit or vegetables to be packaged and the respiration rates thereof.

Instead of having a package with a rigid receptacle, it will be appreciated that for certain fruits and vegetables which can withstand handling, the package may be wholly flexible, and may consist entirely or in part of the gas-pervious polymeric film.

EXEMPLIFICATION OF THE INVENTION

The invention will now be illustrated by the following Examples, in which Examples 1 to 3 describe the preparation of lidding materials for heat-sealing to rigid containers to form packages.

EXAMPLE 1

A film of polymethyl pentene 50 micron thick was corona discharge treated to give a surface wetting tension of 38 to 42 dyne/cm and was then primed with a polyurethane primer of the type available commercially from A. Holdens Limited and known as "Holdens" 2728/2776. The primer was applied at a dry weight in the range of 0.3 to 0.5 g./m$^2$. An acrylic coating, again available from A. Holdens Limited and known as "Holdens" 1788, was applied overall to give a dry application weight of from 1 to 5 g./m$^2$, a weight of 2 to 3 g./m$^2$ being preferred as this gives adequate heat seal strength without unduly inhibiting gas transmission. Oxygen transmission of this film was measured at 24300 cc/m$^2$/d/atm. at 25° C.

EXAMPLE 2

In this Example, a 25 micron thick polymethyl pentene film was corona discharge treated to give a surface wetting tension of 38 to 42 dyne/cm. before being primed as above, and was then coated overall with the same acrylic coating at a dry application weight of 2 g./m$^2$. Oxygen transmission rate of this film was measured at 44000 cc/m$^2$/d/atm. at 25° C.

EXAMPLE 3

Examples 1 and 2 were repeated with the addition of a non-ionic surfactant to the acrylic coating at a level of 3% on the polymer. This gave the films a much improved antifog property to the inner surface of the lid, allowing improved visibility to packed fruit and vegetables.

EXAMPLE 4

A variety of packages was formed by heat-sealing the lidding materials of Examples 1 to 3 to preformed rigid containers (a) formed from PVC sheet of 300 to 400 micron thickness and (b) formed from thermoplastic lined moulded pulp and containing fruit or vegetables.

It was found that when strawberries, raspberries, plums, mushrooms, broccoli, mange tout and beansprouts were packaged in these containers they had an extended shelf-life as compared with the same fruits and vegetables presented in open containers.

When the lidding material of Example 1 was used to package strawberries, it was found that after four days an equilibrium atmosphere comprising 0 to 1% oxygen and 7 to 8% carbon dioxide by volume was attained in the package. Likewise, when using the lidding material of Example 2, an equilibrium atmosphere of 1 to 3% oxygen and 4 to 6% carbon dioxide by volume was attained. With raspberries, the equilibrium atmosphere in the package after four days was 3 to 4% oxygen and 5 to 6% carbon dioxide by volume.

It will of course be appreciated that the temperature at which the packages are maintained will affect the shelf-life of the fruit or vegetables and the best results for strawberries and raspberries are attained if the temperature is maintained at about 5° C.

DETAILED DESCRIPTION OF THE DRAWING

In order further to illustrate the present invention, reference will now be made to the accompanying drawing which shows diagrammatically and by way of example a section through a package of strawberries.

Referring now to the accompanying drawing there is shown a package of strawberries 1. The package comprises a rigid flanged tray 2 formed of moulded fibre and having a thin lining 3 of 80 microns thick, comprising PVC/ionomer, adhered to the fibre. The tray has a lid 4 in accordance with Example 1 above and comprising a film 5 of polymethylpentene 50 microns thick, a layer 6 of polyurethane primer and an acrylic coating 7. The lid is heat sealed to the flange 8 of the tray 2.

The lid has an oxygen transmission of 24300 cc/m$^2$/d/atm at 25° C. and as a result of the presence of the lid an optimum equilibrium atmosphere, which is rich in carbon dioxide and poor in oxygen as compared with the ambient air, is set up within the package and this serves to retard spoilage, mould growth and deterioration in flavour and/or texture of the strawberries.

In order to make the package shown in the drawing, moulded pulp trays may be lined with the lining 3 in a thermo-forming operation in which a film of the lining 3 is heated and drawn into the tray by vacuum in conventional manner. The trays are then filled with strawberries, or other produce and covered with a film of the lid 4 which is heat-sealed to the flange of the tray.

We claim:

1. A package of fresh fruit or vegetables, comprising the fruit or vegetables packaged in a container, at least a part of a wall of said container being made of a transparent film of a polymeric material selected from the group consisting of polymethyl pentene and copolymers of polymethyl pentene, said film having a permeability to oxygen within the range of from about 20,000 to 80,000 cc/m$^2$/d/atm at 25° C. and a permeability to carbon dioxide higher than its permeability to oxygen, and said film being impervious to the ingress of bacteria to the interior of the package.

2. The package of claim 1, said container being made entirely of said film of polymeric material.

3. The package of claim 1, said container comprising a rigid punnet, tray or like receptacle with a lid of said film of polymeric material.

4. The package of claim 3, wherein the receptacle is preformed from a thermoplastic material.

5. The package of claim 4, wherein the thermoplastic material is polyvinyl chloride.

6. The package of claim 3, wherein the receptacle is formed of a non-thermoplastic material, and the receptacle is lined with a thermoplastic material.

7. The package of claim 6, wherein said non-thermoplastic material is moulded pulp.

8. The package of claim 1, wherein the film is coated, at least in part, with a polymer having a lower softening point than that of polymethyl pentene.

9. A method of packaging fresh fruit or vegetables, comprising the steps of placing the fruit or vegetables into a container, at least a part of the wall of which is made of a transparent film of a polymeric material selected from the group consisting of polymethyl pentene and copolymers of polymethyl pentene, said film having a permeability to oxygen within the range of from about 20,000 to 80,000 cc/m$^2$/d/atm at ≅° C. and a permeabiity to carbon dioxide higher than its permeability to oxygen; said film being impervious to the passage of bacteria therethrough into the interior of the package, and closing the package by a heat-sealing operation.

10. A method of packaging fresh fruit or vegetables, comprising the steps of placing the fruit or vegetables in a rigid, preformed punnet, tray or the like receptacle formed of or lined with a thermoplastic material, covering the receptacle with a film which is transparent at least in part and which is made of a polymeric material selected from the group consisting of polymethyl pentene and copolymers of polymethyl pentene, said film having a permeability to oxygen within the range of from about 20,000 to 80,000 cc/m$^2$/d/atm at 25° C. and a permeability to carbon dioxide higher than its permeability to oxygen, and heat-sealing said film to the receptacle to form a lid to the receptacle.

11. The method of claim 10, said receptacle being made of preformed thermoplastic material.

12. The method of claim 10, said receptacle being made of moulded fibre pulp and lined with a termoplastic material.

13. The method of claim 9, said film having a permeability to carbon dioxide in excess of 10,000 $cc/m^2/d/atm$ at 25° C.

14. The method of claim 10, said film having a permeability to carbon dioxide in excess of 100,000 $cc/m^2/d/atm$ at 25° C.

15. The package of claim 1 wherein the film has a permeability to carbon dioxide in excess of 100,000 $cc/m^2/d/atm$ at 25° C.

* * * * *

UNITED STATES PATENT AND TRADEMARK OFFICE

CERTIFICATE OF CORRECTION

PATENT NO. : 4,769,262

DATED : September 6, 1988

INVENTOR(S) : Ferrar et al.

It is certified that error appears in the above-identified patent and that said Letters Patent are hereby corrected as shown below:

In Column 2, Line 11, immediately following the word "polymer", insert --.--.

In Column 2, Line 41, delete "380°" and substitute therefor ---38°--.

In Column 4, Line 47, delete the symbol for "approximately equal to" and substitute therefor ---25--.

In Column 5, Line 5, delete "10,000" and substitute therefor --100,000--.

Signed and Sealed this

Thirty-first Day of January, 1989

*Attest:*

*Attesting Officer*

DONALD J. QUIGG

*Commissioner of Patents and Trademarks*